US006019481A

United States Patent [19]

Ambach et al.

[11] Patent Number: 6,019,481

[45] Date of Patent: Feb. 1, 2000

[54] LIGHT FIXTURE WITH RECESSED ELECTRICAL OUTLET, DATA RECEPTACLE, AND SUPPORT FRAME FOR MOUNTING ON A WALL

[75] Inventors: Douglas C. Ambach, Hamilton, Ohio; Dale A. Nobbe, Oldenburg, Ind.

[73] Assignee: Hill-Rom, Inc., Batesville, Ind.

[21] Appl. No.: 09/018,663

[22] Filed: Feb. 4, 1998

Related U.S. Application Data

[63] Continuation-in-part of application No. 08/705,214, Aug. 29, 1996, Pat. No. 5,735,593.

[51] Int. Cl.[7] ..... F21S 1/02; E04F 19/00; A47B 96/06

[52] U.S. Cl. ..... 362/147; 362/217; 362/220; 362/221; 362/222; 362/223; 362/225; 362/285; 362/287; 362/368; 362/372; 362/801; 362/427; 362/249; 362/250; 362/251; 52/220.1; 52/28; 52/36.1; 52/36.4; 248/223.41; 248/225.11

[58] Field of Search ..... 362/147, 217, 362/220, 221, 222, 223, 225, 285, 287, 368, 372, 801, 427, 249, 250, 251; 52/220.1, 28, 36.1, 36.4; 248/223.41, 225.11

[56] References Cited

U.S. PATENT DOCUMENTS

| | | | |
|---|---|---|---|
| 2,215,531 | 9/1940 | Pieper | 362/33 |
| 2,998,508 | 8/1961 | Bobrick | 362/85 |
| 3,007,038 | 10/1961 | Anisfield | 362/243 |
| 3,084,247 | 4/1963 | Bobrick | 362/85 |
| 3,201,582 | 8/1965 | Siegel | 362/295 |
| 3,354,301 | 11/1967 | Bobrick | 362/147 |
| 3,462,892 | 8/1969 | Meyer | 52/28 |
| 3,567,842 | 3/1971 | Meyer | 174/48 |
| 3,660,591 | 5/1972 | Schultz et al. | 174/70 R |
| 3,702,928 | 11/1972 | Alger | 362/33 |
| 3,769,502 | 10/1973 | Schultz et al. | 362/85 |
| 3,919,540 | 11/1975 | Burst et al. | 362/130 |
| 4,104,710 | 8/1978 | Damico et al. | 362/130 |
| 4,204,274 | 5/1980 | Lüderitz | 362/239 |
| 4,589,557 | 5/1986 | Bollman | 211/94.01 |
| 4,646,211 | 2/1987 | Gallant et al. | 362/149 |
| 4,651,258 | 3/1987 | Davis et al. | 362/147 |
| 4,816,969 | 3/1989 | Miller | 362/130 |
| 4,891,897 | 1/1990 | Gieske et al. | 40/618 |
| 5,272,608 | 12/1993 | Engle | 362/225 |
| 5,277,005 | 1/1994 | Hellwig et al. | 52/220.1 |
| 5,735,593 | 4/1998 | Gallant et al. | 362/147 |

FOREIGN PATENT DOCUMENTS

| | | |
|---|---|---|
| 297846 | 4/1972 | Australia . |
| 1554391 | 12/1968 | France . |
| 3506030A1 | 8/1986 | Germany . |
| 297 17 690 | 1/1998 | Germany . |

OTHER PUBLICATIONS

*The Horizon Headwall System from Hill–Rom*, 1994.

*Primary Examiner*—Sandra O'Shea
*Assistant Examiner*—Ronald E. DelGizzi
*Attorney, Agent, or Firm*—Barnes & Thornburg

[57] ABSTRACT

A light fixture apparatus including a support frame, a light box coupled to the support frame and a hollow housing portion coupled to the support frame alongside the light box. An opening is provided in the housing and a horizontal electrical outlet is in the housing portion opposite the opening. The housing portion includes the first cover pivotally coupled to the support frame at a first end and spaced from the support frame at a second end to form the opening. A second cover is secured in the housing to enclose the wiring of the electrical outlet.

12 Claims, 3 Drawing Sheets

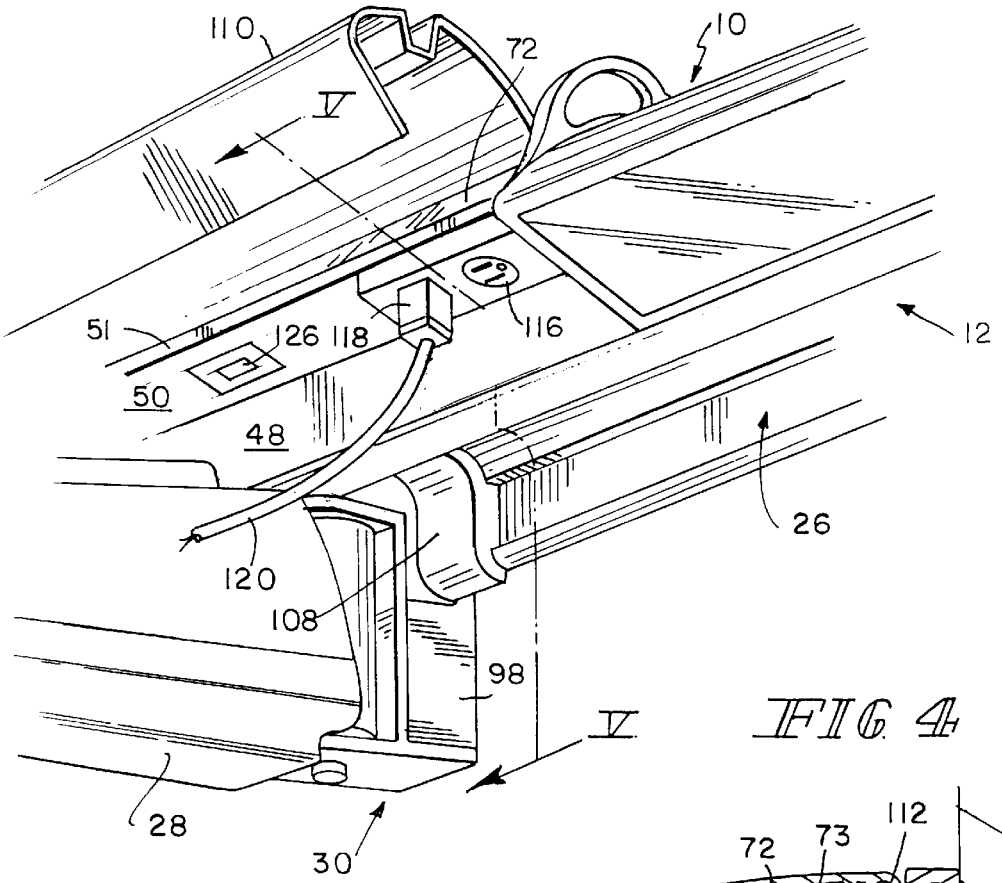
FIG 4
FIG 5
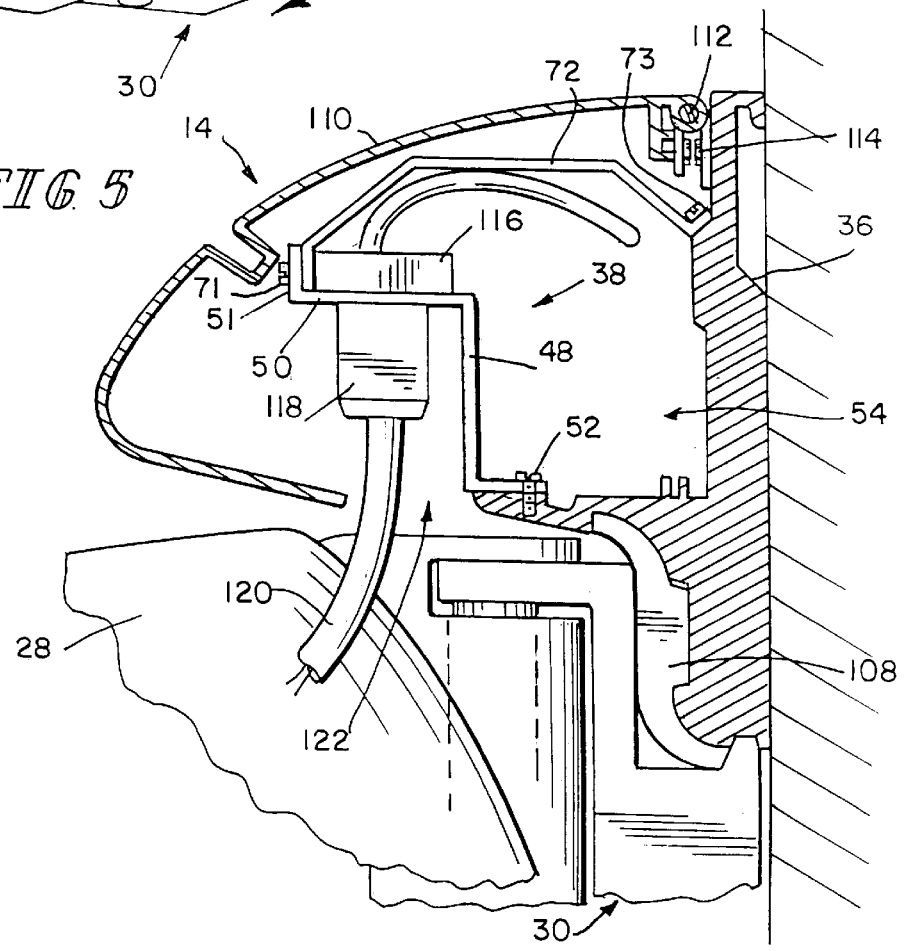

LIGHT FIXTURE WITH RECESSED ELECTRICAL OUTLET, DATA RECEPTACLE, AND SUPPORT FRAME FOR MOUNTING ON A WALL

CROSS-REFERENCE

This is a continuation in part of U.S. patent Ser. No. 08/705,214 filed Aug. 29, 1996 now U.S. Pat. No. 5,755, 593, which is incorporated herein by reference.

BACKGROUND AND SUMMARY OF THE INVENTION

The present invention relates to a light fixture apparatus for mounting on a wall of a room, such as in a hospital room. More particularly, the present invention relates to a light fixture apparatus which facilitates mounting of accessory items to the wall and connection to electrical power to facilitate equipment management within the hospital room.

Some conventional hospital rooms are provided with a track mounted on a wall of the hospital room. When the track is installed, back plating must be added behind the wall in order to support devices such as accessory items coupled to the track. The track includes an electrical raceway for providing power to the track. Light fixtures or other devices are then mounted on the track in a desired position.

The light fixture apparatus of the present invention is designed to support heavy devices such as a patient monitor arm which can weigh 80 pounds or more. The light fixture apparatus of the present invention does not require back plating to be installed behind the wall. This facilitates installation of the light fixture apparatus. The customer simply installs the light fixture apparatus of the present invention by anchoring the light fixture to studs of the wall. The customer then can install a monitor arm, or any other designed accessories onto a track formed on the light fixture without doing any further construction to the wall.

Heavy pieces of equipment are anchored to the light fixture apparatus with a mounting block fastener. The present invention also includes an accessory mounting block which is easily installed onto and released from the track on the light fixture to support smaller accessory items.

The light fixture apparatus of the present invention including a support frame configured to be mounted to a wall and a light box coupled to the support frame. A hollow housing portion is also coupled to the support and frame alongside the light box. An opening is provided in the housing and a horizontal electrical outlet is in the housing portion opposite the opening. The housing portion includes a first cover pivotally coupled to the support frame at a first end and spaced from the support frame at a second end to form the opening. A second cover is secured in the housing to enclose the wiring of the electrical outlet. A horizontal data or communication receptacle is also provided in the housing opposite the opening. While the support frame, preferably, is made from extruded metal material, the hollow housing is made from sheet metal.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which:

FIG. 4 is a perspective view of an end-portion with the cover open showing the electrical outlets incorporating the principles of the present invention.

FIG. 5 is a cross-sectional view taken along lines VV of FIG. 4 with the cover in its down position.

DETAILED DESCRIPTION OF THE DRAWINGS

Figure 1:
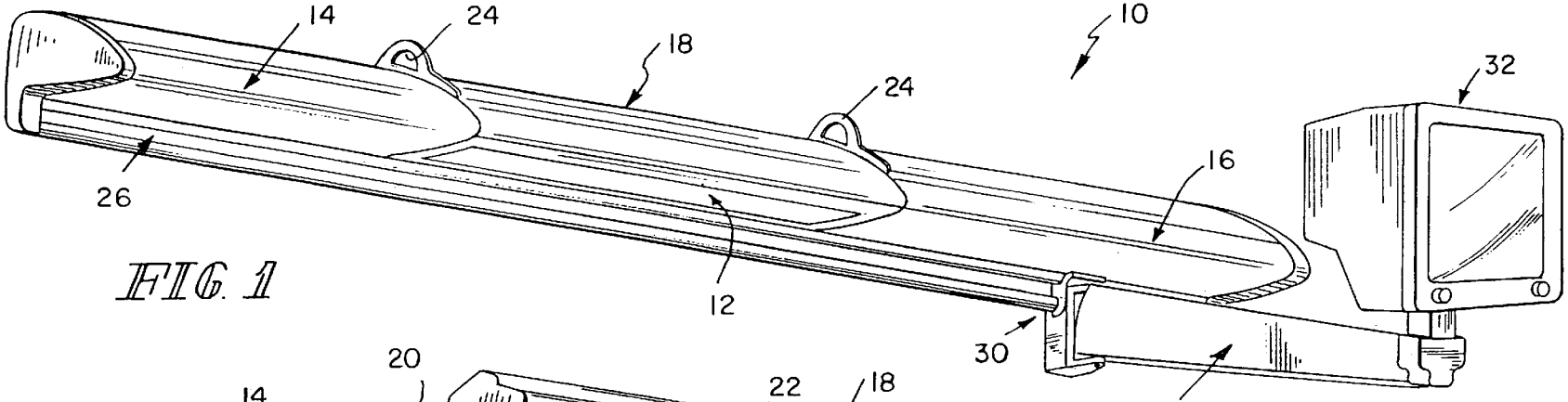
FIG. 1 is a perspective view of the light fixture apparatus of the present invention with a monitor arm attached to a track on the light fixture.
Figure 2:
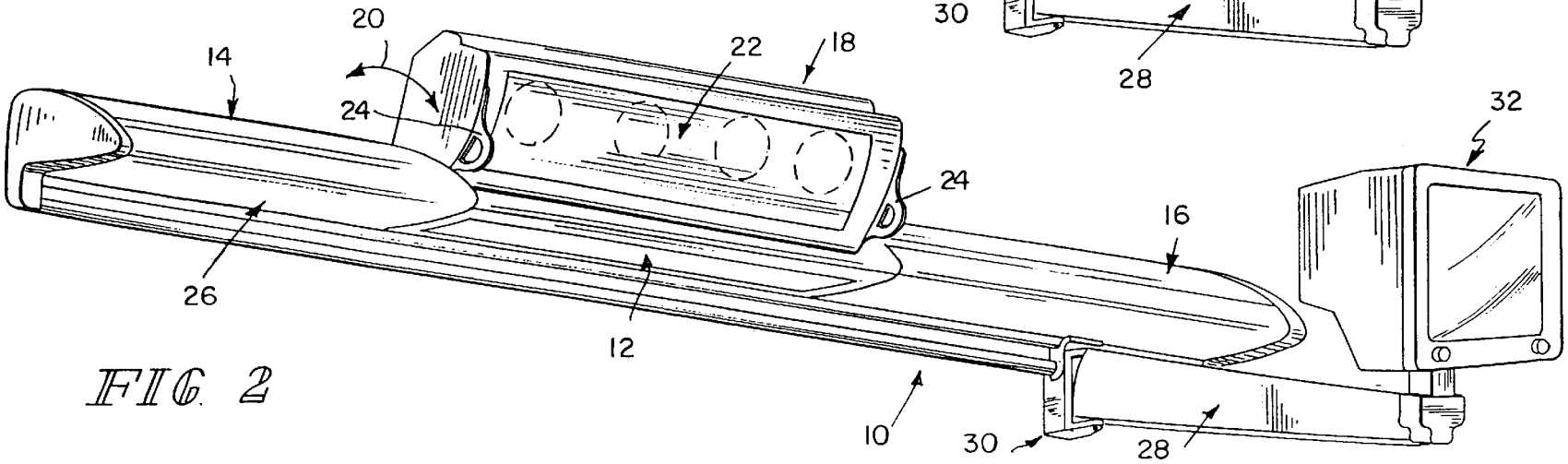
FIG. 2 is a perspective view similar to the FIG. 1 in which a central auxiliary light has been flipped over.

Referring now to the drawings, FIGS. 1 and 2 illustrate a light fixture apparatus 10 of the present invention. The light fixture 10 includes a central light box 12 for holding a light source therein. The light fixture 10 also includes hollow end portions 14 and 16 on opposite sides of the light box. A flip-out auxiliary light source 18 is located above light box 12. As illustrated in FIG. 2, the auxiliary light source 18 is pivotable in the directions of double-headed arrow 20 to direct the auxiliary light source 22 toward a patient, such as during an exam. Handles 24 are provided on opposite ends of the auxiliary light 18.

Light fixture 10 further includes an accessory track 26 for mounting accessory items onto the light fixture 10. For instance, a monitor arm 28 can be coupled to the track 26 with a fastener assembly 30 best disclosed in FIG. 3. A monitor 32 is cantilevered from the track 26 by the monitor arm 28 and fastener assembly 30.

Figure 3:
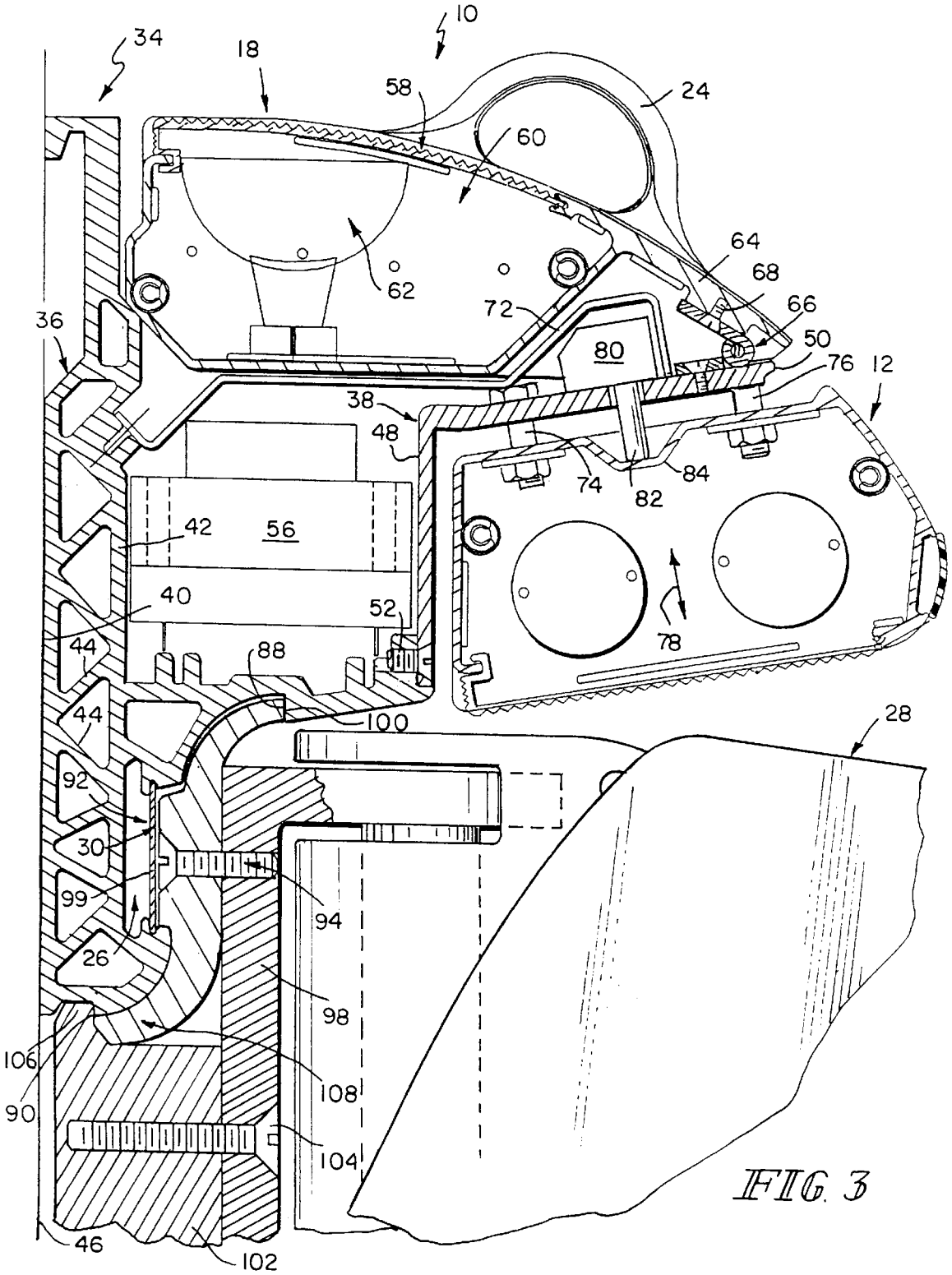
FIG. 3 is a sectional view taken through the light fixture apparatus of FIG. 1 illustrating a reinforced support member and a first mounting bracket assembly for securing a heavy piece of equipment such as the monitor arm to the light fixture apparatus.

Details of the light fixture 10 are illustrated in FIG. 3. Light fixture 10 is designed to be mounted directly to studs of a wall 46. In most instances, the light fixture 10 permits mounting of accessory items such as the monitor 32 onto track 26 without the use of back plating behind the wall. This facilitates installation of the light fixture 10.

Light fixture 10 includes a reinforced support frame 34 having a first support member 36 and a second support member 38. Preferably, first support member 36 is formed from an extruded metal material, such as aluminum for strength. First support 36 includes a pair of parallel support walls 40 and 42 interconnected by webs 44. Therefore, the first support provides a reinforced support assembly for the light fixture 10. The first support member 36 is coupled directly to studs in a wall 46 to secure the light fixture 10 to the wall 46. In most instances, back plating is not required for the light fixture 10 due to the reinforced support 34.

The second support member 38 is preferably made from sheet metal and has a first, vertically extending section 48 and a second, generally horizontally extending section 50. Second support member 38 is coupled to the first support member 36 by suitable fasteners 52. An interior region 54 is defined between the first support 36 and the second support member 38 for receiving components such as a ballast 56.

The auxiliary light source 18 includes a housing 58 defining an interior region 60 for holding the auxiliary light source 62. Illustratively, the auxiliary light source 62 is a halogen lamp. However, any light source may be used. A front wall 64 of housing 58 is coupled to horizontal leg 50 of second support 38 by hinges 66. The first side of each hinge 66 is coupled to the wall 64 by a fastener 68. A second side of each hinge 66 is coupled to horizontal leg 50 by fastener 70. An internal sheet metal cover 72 is provided for protecting and shielding internal parts of the light fixture 10 when the auxiliary light 18 is flipped to its open position illustrated in FIG. 2. A fastener 73 secures the cover 72 to the first support member 36.

Light box 12 is coupled to horizontal leg 50 by fasteners 74 and 76. Fasteners permit limited movement of the light box 12 relative to horizontal leg 50 in the directions of double-headed arrow 78. A switch 80 is also coupled to horizontal leg 50. Switch 80 includes a plunger 82 configured to deactivate the bed when plunger 82 is engaged. In other words, if an item makes contact with light box 12 and pushes the light box 12 upwardly toward horizontal leg 50, a top surface 84 of light box 12 engages plunger 82 to deactivate movement of the bed. The obstruction must be cleared to release the plunger 82 in order to restore power to move the bed.

FIG. 3 also illustrates further details of the mounting track 26 and the fastener assembly 30. The mounting track 26 is a generally S-shaped track including a first, upper stop 88 and a second, lower stop 90. A recessed portion 92 of track 26 provides room for a fastener 94.

Fastener assembly 30 includes a S-shaped mounting block 96 configured to be coupled to a desired item such as bracket 98 of monitor arm 28 by the fastener 94. An HPL laminate facia insert 99 is coupled to first support member 36 adjacent track 26. A top end 100 of mounting block 96 is configured to abut the first stop 88 on support 36. Mounting bracket 98 is also secured to a second mounting block 102 by fastener 104. Mounting block 102 is formed to include a top flange 106 configured to engage the second stop 90 of the support member 36. A bottom end 108 of mounting block 96 is trapped between support member 36 and mounting block 102.

FIGS. 4 and 5 illustrate the configuration of the hollow end portions 14 and 16 of the light fixture 10. A movable cover 110 is coupled to support 36 by a hinge 112. A first fastener 114 secures the hinge 112 to the first support member 36. The second support member 38 has a first vertically extending portion 48, a second generally horizontally extending section 50 and a third vertically extending section 51. The second support member 38 is coupled to the first support member 36 by the fasteners 52. Mounted in openings in the horizontal portion 50 of the second support member 38 is a duplex electrical outlet 116. A plug 118 from the monitor 28 is plugged into the horizontal electrical outlet 116. The wire 120 extends through the gap or opening 122 between the cover 110 and the first support member 36 and the second support member 38. A horizontal outlet allows for ease of insertion removal and further reduces the strain on the plug 118 and the wire 120.

Preferably, the opening 122 between the cover 110 and the support members 36 and 38 is sufficiently small to minimize removal of the plug 118 without rotating the cover 110 about hinge 112. The size of the opening 122 also minimizes contact of the outlet 116 by individuals and thereby reducing the risk of electrocution as well as damaging the outlet or a communication or data jack.

The space 54 between the first support 36 and second support 38 is enclosed by cover 72 secured to the first support 36 by fastener 73 and to vertical wall 51 of support 36 by fastener 71. This provides an enclosed cable housing or duct.

Also provided in the vertical wall 50 of the second support 38 is a data or communication jack or receptacle 126. This allows connection of the monitor or other equipment to a communication bus.

Although the cover 110 is preferably shown as a single unit, the two-piece cover 110 with living hinge of the previously mentioned patent application may also be used although not preferred. The pivoting of the cover 110 about pivot 112 provides not only access to the outlet 116 and the jack 120, but also allows movement of the cover 110 if force is applied thereto by, for example, an I.V. pole or other equipment within the room related to the patient.

Although the invention has been described in detail with reference to certain preferred embodiments, variations and modifications exist within the scope and spirit of the present invention as described and defined in the following claims.

What is claimed is:

1. A light fixture apparatus configured to be mounted to a wall, the apparatus comprising:

a support frame configured to be mounted to the wall;

a light box coupled to the support frame;

a hollow housing portion coupled to the support frame along side the light box;

an opening in the housing portion; and a horizontally disposed electrical outlet in the housing portion opposite the opening.

2. The apparatus of claim 1, wherein the support frame is made from an extruded metal material.

3. The apparatus of claim 1, wherein the support frame includes a first support member configured to define a track and a second support member coupled to the first support section for supporting the outlet.

4. The apparatus of claim 3, wherein the housing portion is made from a sheet metal material.

5. The apparatus of claim 1, wherein the housing portion includes a first cover pivotably coupled to the support frame at a first end and spaced from the support frame at a second end to form the opening.

6. The apparatus of claim 5, including a second cover secured in the housing to enclose the wiring of the electrical outlet.

7. The apparatus of claim 1, including a horizontally disposed data receptacle in the housing portion opposite the opening.

8. The apparatus of claim 1, wherein the receptacle outlet is recessed from the opening in the housing portion.

9. The apparatus of claim 1, wherein the electrical outlet is recessed in the housing portion from the opening sufficient such that a plug received in the outlet is within the housing portion.

10. The apparatus of claim 5, wherein the opening of the housing is sufficiently small to minimize access to the outlet without pivoting the first cover.

11. The apparatus of claim 10, wherein the receptacle outlet is recessed from the opening in the housing portion.

12. The apparatus of claim 1 wherein the electrical outlet is situated opposite to and above the opening.

* * * * *